US005462258A

United States Patent [19]

Gaillard et al.

[11] Patent Number: 5,462,258

[45] Date of Patent: Oct. 31, 1995

[54] ROAD CRASH BARRIER COMPRISING AT LEAST ONE HORIZONTAL WOODEN RAIL

[75] Inventors: Christian Gaillard; Thierry Papineschi, both of Beziers, France

[73] Assignee: Compagnie Francaise des Etablissements Gaillard, Beziers, France

[21] Appl. No.: 211,116

[22] PCT Filed: Sep. 11, 1992

[86] PCT No.: PCT/FR92/00855

§ 371 Date: Mar. 21, 1994

§ 102(e) Date: Mar. 21, 1994

[87] PCT Pub. No.: WO93/07340

PCT Pub. Date: Apr. 15, 1993

[30] Foreign Application Priority Data

Sep. 30, 1991 [FR] France ..... 91 12282

[51] Int. Cl.[6] ..... A01K 3/00

[52] U.S. Cl. ..... 256/13.1; 256/19; 248/66

[58] Field of Search ..... 256/13.1, 19, 1, 256/59, 65, 64, 24, 31; 404/6, 10, 7, 8, 9; 248/66

[56] References Cited

U.S. PATENT DOCUMENTS

| | | | |
|---|---|---|---|
| 1,793,675 | 2/1931 | Camp | 256/13.1 |
| 1,824,454 | 9/1931 | White . | |
| 2,024,998 | 12/1935 | Gleason et al. | 256/13.1 |
| 2,085,058 | 6/1937 | Wood . | |
| 2,088,001 | 7/1937 | Schulz | 256/13.1 |
| 2,168,930 | 8/1939 | Bradshaw | 256/13.1 |
| 4,722,513 | 2/1988 | Gaillard et al. | 256/13.1 |
| 4,946,138 | 8/1990 | Gaillard et al. | 256/13.1 |
| 5,169,127 | 12/1992 | Eynard | 256/13.1 |

FOREIGN PATENT DOCUMENTS

| | | | |
|---|---|---|---|
| 0184525 | 6/1986 | European Pat. Off. . | |
| 0228334 | 7/1987 | European Pat. Off. . | |
| 2496153 | 6/1982 | France | 256/19 |
| 2589176 | 4/1987 | France | 256/13.1 |
| 2592074 | 6/1987 | France . | |
| 2623829 | 6/1989 | France . | |
| 2633319 | 12/1989 | France | 256/13.1 |
| 1295582 | 5/1969 | Germany . | |

*Primary Examiner*—Randolph A. Reese
*Assistant Examiner*—Harry C. Kim
*Attorney, Agent, or Firm*—Dvorak and Traub

[57] ABSTRACT

A road crash barrier including a wooden rail (1), which may be formed of horizontal rail elements (3) assembled end to end, supported by posts (2). The rail (1) is covered over a portion of its surface by elongate plane rectangular plates (5) of small section which are fixed against a surface of the rail (1) facing away from the road traffic axis (13). The rectangular plates lie in the horizontal plane that includes the axis of the rail, and may include one or more deformation zones formed by a fold in the plate. At ends of the rectangular plates (5) are holes through which bolts (9) pass to fix a plate to an adjacent coupling plate, and the associated wooden element (3). At least one end of some of the plates have elongate shape holes (12).

10 Claims, 3 Drawing Sheets

ROAD CRASH BARRIER COMPRISING AT LEAST ONE HORIZONTAL WOODEN RAIL

BACKGROUND OF THE INVENTION

The present invention relates to road crash barriers comprising at least one horizontal wooden rail.

The main application of the invention lies in making road crash barriers, however the assembly of elements constituting them could be used for other purposes, in particular whenever there is a risk of a wooden element being subjected to a longitudinal traction force and/or an accidental impact that might cause it to break.

Nevertheless, the technical sector that uses all of the characteristics of said assembly and the combination of elements constituting it lies in the field of road crash barriers.

Such crash barriers are well known, placed on the sides of roads and motorways to retain vehicles that accidentally leave the normal traffic paths thereof.

Such crash barriers include one or more horizontal rails, connected to posts that are fixed to the ground, and in the event of an impact from a vehicle they must be capable of withstanding large forces without breaking: various classes or levels of force have been defined by the national authorities in numerous countries, and in France the competent authority is the "Minist`ere de l'Equipement, du Logement, de l'Aménagement du Territoire et des Transports". That authority has established three classes in particular, with the highest class thereof corresponding to a level 1 that applies to use on motorways and on high-traffic roads.

For this purpose, the rails of crash barriers are generally made up of metal bar elements that are assembled together to ensure continuity, and that make it relatively easy to reach the strength required by the above-mentioned top level.

In addition, and in particular to improve the appearance of such crash barriers, so that they meld better with a rural or an urban environment, and/or so as to integrate them in landscaping development, numerous manufacturers have sought, and are still seeking, to develop crash barriers constituted by wooden rails: nevertheless, the traction strength and the impact strength of this material is naturally much less than that of steel, and at present, few crash barrier implementations that make use of wood can withstand static traction forces exceeding 200 kNewtons, which means they are out of contention for the highest classification mentioned above; and even then such a value can be achieved only when using special coupling and assembly devices for rails made up of wooden elements that are generally identical and need to be held together end to end, like those mentioned below.

In an attempt to improve the strength of such wooden crash barriers, various assemblies and types of crash barriers have been developed, some of which have constituted the subject matter of patent applications, such as:

U.S. Pat. No. 1,824,454, filed Mar. 26, 1931 by William E. White, who, judging that wood is not strong enough on its own, added a strip of iron to the front face of the rail, which strip covered the entire length and area thereof, and thus served, itself to provide the necessary impact and traction strength. Similarly, U.S. Pat. No. 2,085,058 (Wood) filed Mar. 12, 1934 describes a crash barrier including a cable for withstanding forces, with the wood then serving essentially, as in the preceding patent, to improve appearance and visibility, and also because it is relatively inexpensive. By implementing either of those two patents, it is indeed possible to obtain the desired strength, but only at the cost of using large metal elements that are therefore expensive, and even, in the White patent, the metal strip which covers the wooden rail hides it completely and eliminates most of the desired improvement in appearance. Neither of those two relatively old patents has been the subject of development for major application in the field of protecting road traffic.

More recently, for the purpose of retaining the advantages of appearance, the present inventors have developed rails made of wood only, associated with systems for coupling and attaching rail elements to one another in order to improve strength at their ends, e.g. as described in European patent EP 184 525 in the name of Mr. Eynard, dated Nov. 13, 1985, or French patent FR 2 592 974 in the name of Etablissements Galliard, filed Dec. 23, 1985 and relating to metal strap fastenings placed across the ends of the rails in which they are set back, said rails themselves also being constituted by wooden poles: additions to and improvements in the strength of such straps have subsequently constituted the subject matter of certificates of addition, in particular concerning the addition of anchoring spikes to the straps.

Nevertheless, even in the context of developments of the above assembly, the maximum traction strengths that it is has been possible to achieve are 200 kNewtons, which is not sufficient to qualify for level 1 of the classification.

SUMMARY OF THE INVENTION

Thus, the problem posed is how to implement crash barriers whose rails are made of wood with a maximum amount of wood being visible on the outside surfaces thereof for reasons of appearance, while nevertheless being strong enough to hold traction forces greater than those that can be accepted by a rail made of wood only, without adding longitudinal metal elements thereto suitable for holding said forces on their own, while ensuring that the rails are capable of obtaining the highest level of approval in national standards.

One solution to the problem posed is a road crash barrier of the type comprising at least one horizontal rail made up of wooden elements that are assembled end to end and that are supported by posts, which rail, as taught by the White patent, is also covered over a portion of its surface with a continuous metal strip; however in the present invention said strip is made up of elongate plane rectangular plates of small section that are fixed against the surface of the rail facing away from the road traffic axis, and lying in the horizontal plane that includes the axis of the rail, some rectangular plates constituting the continuous strip including at least one deformation zone capable of enabling each length of the strip corresponding to an associated wooden element to lengthen by a certain amount.

In addition, in order to add to the elongation effect made possible by said deformation zones, in a preferred embodiment, said rectangular plates include, at each of their ends, holes through which bolts pass for fixing them to the following coupling plate and the associated wooden element, said holes, at least at one end of some of said plates being elongate in shape.

In a preferred embodiment, the elongate holes are braking slots having an aperture diameter "r" that is smaller towards the end of the rectangular plate in which they are formed.

The result is novel road crash barriers of a type comprising at least one wooden horizontal rail and, for example, for particular dimensions of its component parts, making it possible to withstand static forces of at least 300 kNewtons in traction; whereas a rail made only of wooden posts having a diameter of 180 mm (of the same kind as constitutes the wooden elements in the embodiment enabling the above strength to be obtained) withstand only 200 kNewtons, and the associated metal strip that was used in the example enabling a strength of 300 kNewtons to be obtained had dimensions of 60 mm×6 mm, such that on its own it can withstand only 100 kNewtons.

In other particular embodiments, in which other dimensions of wooden rail could be selected, as could metal strips having different characteristics, it would be possible to obtain static traction strengths other than those mentioned above, being smaller or greater depending on requirements.

The object of the present invention is thus not solely to achieve the above-mentioned limit, but to enable the strengths of wood and of steel to be superposed, which is normally impossible since said materials have different coefficients of extension.

The present invention thus avoids making a crash barrier out of wood that is dimensioned so as to enable it to withstand the entire force on its own, which would give rise to dimensions that are difficult to obtain without paying a very high price, and which would also be difficult to implement.

Surprisingly, the present invention makes it possible to combine the strength of wood with the strength of steel: initially, as has been shown by tests like the example described below, the system behaves as though the wooden rail alone withstands the force which it absorbs in the usual way up to a safety limit below its breaking limit, and this is done with little deformation; thereafter, while the wood continues to absorb said force compatible with its safety limit, while the metal strip takes over by withstanding the additional force applied to the crash barrier as a whole, until it reaches its own breaking point.

The above result has been verified by testing and it is thus indeed the consequence of the particular combination of crash barrier elements as described above and below, whereas in all crash barriers known in the past, and also including both elements made of wood and other elements made of metal, the resulting strength was either that of the wooden elements or else that of the metal elements; thus even though some increase in strength has indeed been obtained in the past, no assembly has enabled forces to be superposed.

In the present invention, since the wood is both the portion of the crash barrier that is most visible and is also the first portion to be subjected to forces and that absorbs the major fraction thereof, a crash barrier must continue to be thought of as being a wooden crash barrier, whereas in the White patent mentioned above by way of example, it is the metal part that plays the major role, both with respect to appearance and with respect to strength, and it is hardly appropriate to continue calling it a "wooden" crash barrier.

In addition, the combination, in the metal parts of the strip situated behind the rail, of deformation zones and of elongate fixing holes, particularly if the holes are braking slots, thus makes it possible to obtain a curve of strain relative to the traction force withstood by the rail that is continuous and without any too steep step increase in stiffness which, under dynamic circumstances, would run the risk of causing premature breakage. Tests have shown, for example, that in the absence of deformation zones and using only parallel-sided slots, when traction forces begin to be applied, the bolts slide in the slots until they come into abutment, and throughout the period of sliding the rear strip is not deformed, it is only the wood that is deformed and that absorbs the forces. However, when the bolts come into abutment in the slots after they have deformed their housings in the wood, then a very sudden stiffening is observed in the deformation curve, due to the small amount of elongation that is allowed by the rear strip, which then does indeed add its strength to that of the wooden rail, but does so in such a manner that in the event of an impact from a vehicle, there is a considerable risk of breakage occurring when this step occurs.

This is eliminated by the existence of deformation zones in the metal strip, which zones lengthen when large forces are applied prior to the strip being subjected directly to the force, thereby smoothing out the above-mentioned step. This effect is combined with the effect of braking slots which, under traction force, transform themselves into parallel-sided slots, thus providing a progressive effect that is better than that of slots which originally have parallel sides. Thus, the three combined actions of the effects of the deformation zones and of the elongate holes enable the wooden rail to deform to a certain extent on its own before the metal strip contributes its own strength, and the braking effect in said holes improves the above effect so that the effects overlap to a greater or lesser extent during extension.

Finally, it may be observed that, as seen from the road traffic axis, the metal strip associated with the wooden rail is fixed behind the rail; this serves firstly to enable the crash barrier to retain its appearance of being made of wood, and secondly it gives full rein to the above-mentioned strength effect without any risk of catching on a vehicle sliding along the crash barrier during an impact, for example. There is therefore no longer any need for the strip to be received in grooves, even if grooves are useful and necessary for other purposes, but solely at the junctions between wooden elements for the purpose of keeping them together end to end, even in the event of the supporting posts breaking.

Other advantages of the present invention could be mentioned, but those mentioned above already suffice for showing the novelty and the advantage of the invention.

The following description and figures relate to an embodiment of the invention that have no limiting character.

Other embodiments are possible in the context of the scope and the extent of the present invention, in particular by changing the basic shape of the element constituting the crash barrier, be they made of wood or of metal.

DETAILED DESCRIPTION OF THE INVENTION

Figure 1:
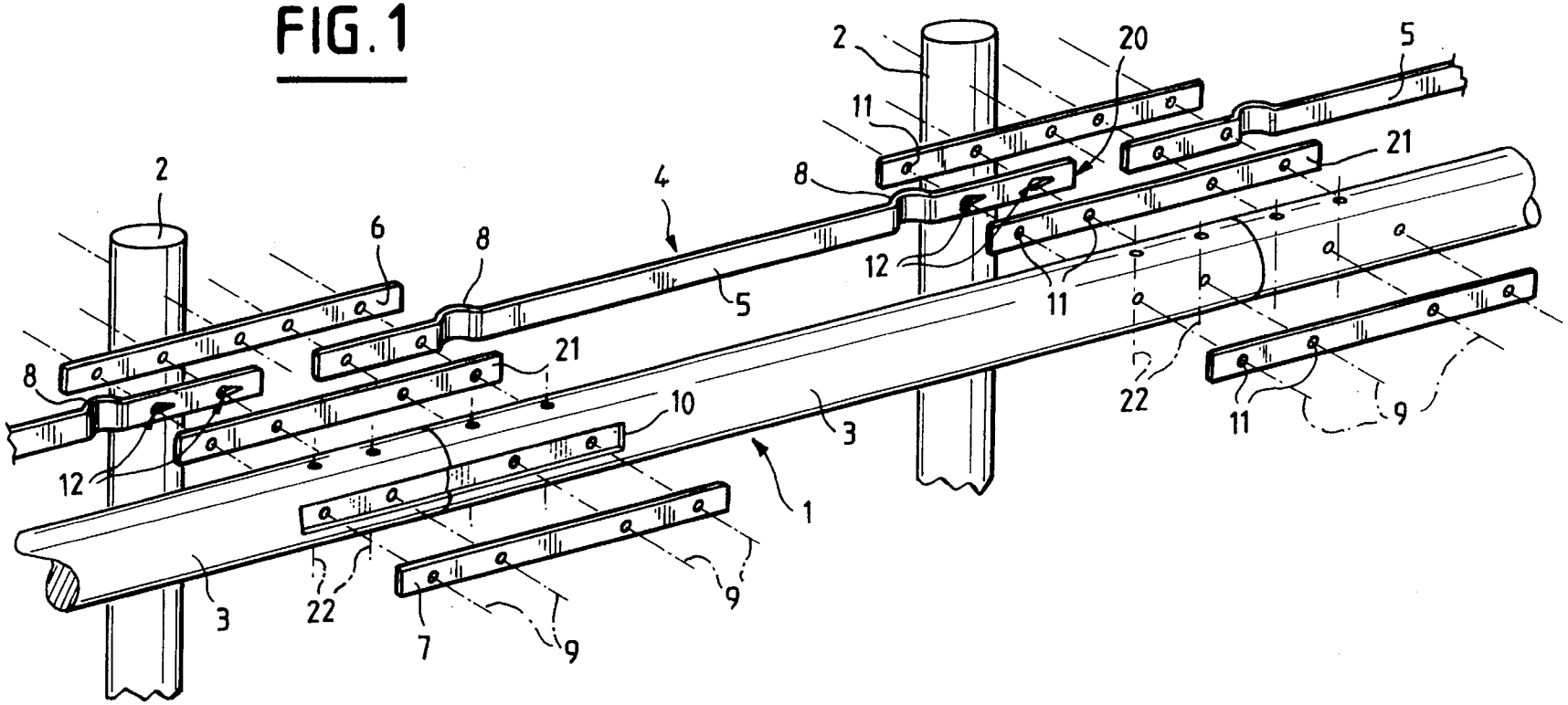
FIG. 1 is an exploded perspective view of a complete crash barrier.
Figure 3:
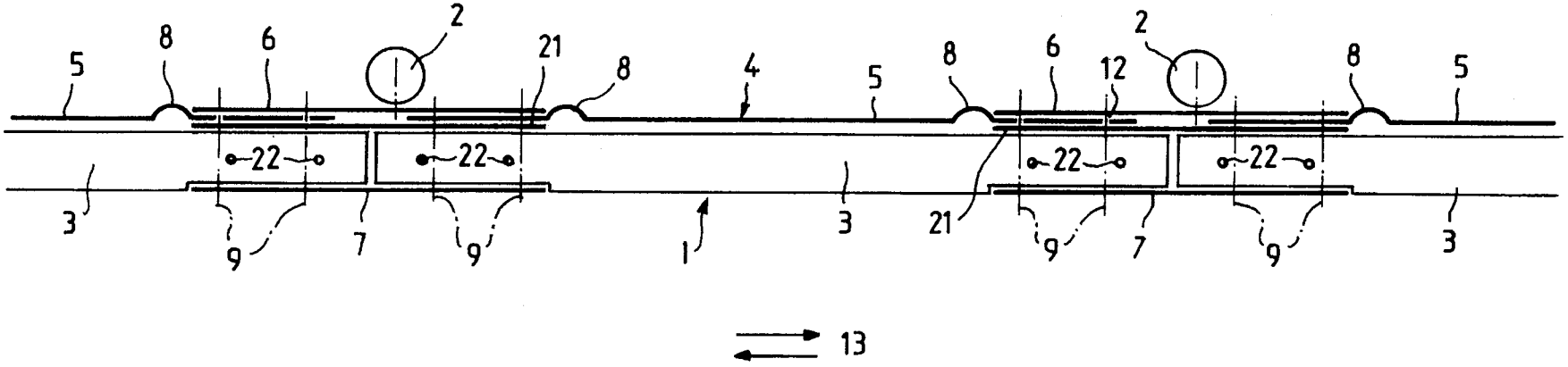
FIG. 3 is a diagrammatic plan view of the FIG. 1 crash barrier.
Figure 4:
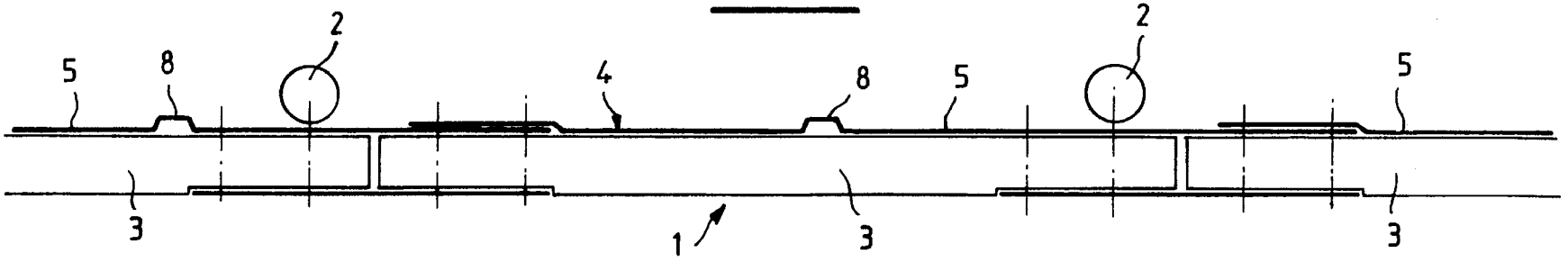
FIG. 4 is a diagrammatic plan view showing another embodiment of the crash barrier.

FIGS. 1, 3, and 4 show a length of road crash barrier of the invention: in conventional manner, the crash barrier comprises posts 2 (which in the present invention are preferably made of wood) supporting a horizontal rail 1 which is made up of wooden elements 3 assembled end to end.

The crash barrier could include a plurality of horizontal rails of the same type.

The posts 2 and the wooden elements 3 are shown herein as being in the form of wooden poles, and that is the preferred way of making them, nevertheless they could be of different section, e.g. rectangular or square.

The rail elements are preferably wooden poles of constant diameter, e.g. corresponding to dimensions that are relatively easy to implement and to handle, namely 160 mm, 180 mm, or 200 mm, and of length lying in the range 1.5 meters (m) to 4 m.

Also preferably, the posts 2 are positioned at junctions between the rail elements 3, however they could be farther apart, with some junctions between elements 3 not being supported by intermediate posts. This general presentation and the way in which the ends of two adjacent wooden elements are joined together are described in an earlier patent application in the name of Etablissement Galliard, such as that mentioned above, No. FR 2 592 064, also filed in Europe together with its additions under the number EP 0 228 334.

Compared with the description of those patent applications, the present invention relates essentially to the existence (in combination with the other crash barrier elements) of a continuous metal strip 4 made up of elongate plane rectangular plates 5 of small section and fixed against the surface of the rail 1 that faces away from the road traffic axis 13, and that lie in a horizontal plane that includes the axis of the rail.

All of said rectangular plates 5, 6 making up said continuous strip include connection holes at each of their ends enabling them to be fixed to one another and through which fixing bolts 9 are passed at certain points that engage the associated wooden element 3 in addition to providing a connection with the following plate.

According to the invention, some of these end holes 12, e.g. those in the rectangular plates 5 that extend along the major fraction of the length of the wooden elements 3, are elongate or "slotted" at at least one end 20.

Figure 2:
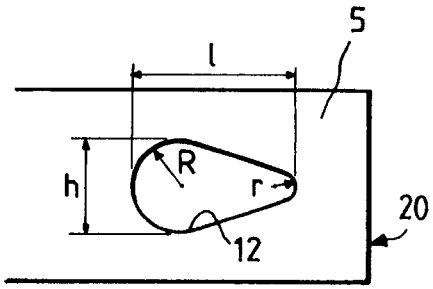
FIG. 2 shows one example of a braking slot.
Figure 5:
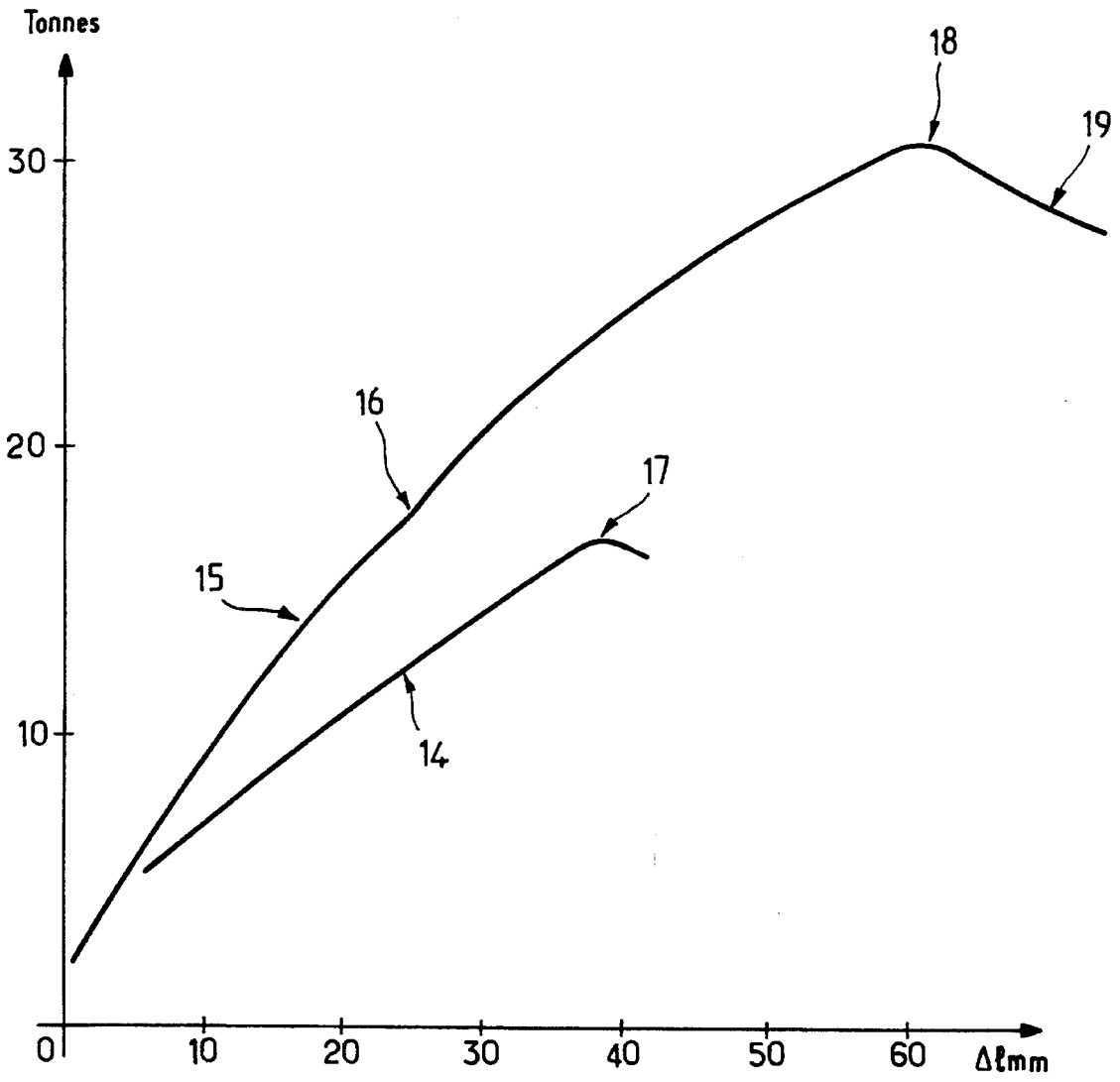
FIG. 5 shows an example of test curves applicable to crash barriers in traction.

The slots 12 are preferably in the form of tapering "braking slots", having an aperture of smaller diameter "r" towards the end 20 of the rectangular plate 5 in which the hole is made, and as shown in FIG. 2. For example, in the context of tests that have been performed, a result of which is shown in FIG. 5, there are preferably two such braking slots of length 22 mm to 30 mm with a hole radius "R" at the large end of 8.25 mm to match fixing bolts 9 having a diameter of 16 mm, while at the opposite end said slots 12 have a hole radius "r" of 5 mm to 7.5 mm.

In the tests performed, the above dimensional characteristics for the braking slots associated with the size of the fixing bolts correspond to wooden elements of diameter 180 mm to 200 mm and of length 1 m to 2.50 m, with the metal plates constituting said continuous strip 4 having a section of 60 mm×6 mm.

In addition to the effect of such braking slots as already mentioned, some of the rectangular plates 5 constituting said continuous rear strip 4 include at least one deformation zone 8 enabling it to impart a certain amount of extra length to the strip for each corresponding length to a wooden element 3 with which the strip is associated. In particular, as shown in FIGS. 1 and 3, this deformation zone may be constituted by a series of folds of any shape, extending, once the strip has been installed, in the horizontal plane that includes the axis of the rail, and giving the strip the possibility of lengthening by 4 mm to 20 mm for each wooden element of the rail. This may be achieved, for example, with a fold in the form of a curve forming a bridge of radius "a" lying in the range 30 mm to 60 mm.

In FIGS. 1 to 3, two deformation zones 8 are shown on a single longitudinal rectangular plate element 5, said element being of length that is no greater than the length of the associated wooden element 3. In this embodiment, it is then necessary to have another metal part or strap 6 for coupling purposes constituting a strap that is at the back of the rail 1 relative to the road traffic axis 13. The strap 6 bridges and overlies the ends of the two adjacent wooden elements, and also the ends of two rectangular plates 5 associated with respective ones of said wooden elements, thereby coupling them together and being fixed thereto by means of through bolts that simultaneously engage a wooden element 3, a rectangular plate 5, and a coupling piece 6.

In this same embodiment of FIGS. 1 and 3, a second metal coupling piece 21 may be added that also constitutes a strap at the back of the rail 1, extending between and overlying the ends of both adjacent wooden elements, like the other strap forming piece 6, said two metal pieces 6 and 21 sandwiching between them the two associated rectangular metal plates 5.

Similarly, in addition to the rear straps as defined above, said crash barrier may include another coupling strap 7 on its surface facing the road traffic 13, said strap lying in a horizontal plane and extending over the two ends of the wooden elements 3, being fixed thereto by bolts that pass right through, clamping the wooden elements between said strap 7 and the rectangular plates constituting the continuous strip at the back of the rail, and in the example shown in FIG. 2, comprising the straps 6 and 21 and the plates 5 taken together.

It is preferable for the last-mentioned coupling strap 7 situated on the front face of the rail 1 to be received in grooves 10 formed in the ends of the wooden elements 3 so that it does not stand proud of its front surface, thereby enabling a vehicle to slide along said surface, with friction, and also serving to keep two such wooden elements connected together end to end, even after a support 2 has been broken. As recalled above, this is taught and described in a previous patent application No. FR 2 592 074 in the name of Etablissements Galliard.

All of these coupling straps that are referenced in FIGS. 1 and 2 and which may be from 1 to 3 in number are of known type and normally they do not include slots as in the other metal plates 5, but they do include holes enabling them to be fixed to one another and to the wooden elements and to the supporting posts 2.

In any event, it is necessary for the set of said coupling straps to be of a section enabling them to withstand the total traction force as supported both by the associated wooden element and metal strip when they combine their strengths as described above. Thus, if there is only one strap it must be of much greater section than is the rectangular plates 5 on its own, and if the strap have the same section as said plate, then there must be at least one other strap and preferably two on either side of the wooden element in order to transmit the strength of the wooden element to the adjacent wooden element.

FIG. 4 is a diagrammatic plan view of another embodiment of a crash barrier of the invention, but in which each wooden element 3 is associated with a metal rectangular plate 5 that is of greater length and that projects beyond at least one end of said wooden element 3, which plate is deformed so as to overlie the end of the metal rectangular plate 5 of the adjacent wooden element 3, such that said ends of the plates are then fixed to each other and to the wooden element by bolts passing through the wooden element.

In addition, in FIG. 4, only one deformation zone 8 is shown, but instead of being circular in shape it may naturally be trapezium-shaped or in the form of some other shape of fold.

Whether the embodiment is as shown in FIGS. 1 and 3 or as shown in FIG. 4, the ends of the rectangular plates 5 and of the strap-forming pieces 6 and 7 that bear directly against the wooden elements 3 may carry spikes that penetrate into the wooden elements, thereby improving the retaining and assembly effect between the metal pieces and said wooden elements. This is described and taught in European application EP 228 334 in the name of Etablissements Gaillard that is derived from the French application already mentioned above.

Similarly, in a preferred embodiment, said slideways may include abutment bars 22 placed vertically in the midplane of the wooden elements 3 perpendicularly to the longitudinally axis thereof and to the axes of the fixing bolts 9, and at a given distance therefrom towards the ends of the wooden elements 3, as taught and described in patent application 2 623 829 filed on Nov. 27, 1987 in the name of Etablissements Gaillard.

When the wood is subjected to a traction force, these bars added ahead of the fixing bolts in their sliding direction serve to provide abutments therefor after a certain amount of deformation has taken place: in the event of a metal strip 5 rupturing, they then make it possible to make use of residual strength 19 in the wooden rail, as shown in FIG. 5.

FIG. 5 is an example of a traction test curve performed on different wooden rails, mounted using the assembly shown in FIGS. 1 and 3, where a first curve 14 is a deformation curve for a 180 mm diameter wooden element on its own when subjected to a longitudinal traction force. A breaking point 17 is obtained for a traction force of the order of 18 metric tons (tonnes) for deformation of less than 40 mm.

The second curve that is shown, 15, corresponds to the deformations suffered by a road crash barrier as shown in FIGS. 1 and 3 using a 180 mm wooden pole as was used for curve 14, but in association with a longitudinal metal element 5 having a section of 60 mm×6 mm. The metal element was connected to a following element by straps 6 and 21 sandwiching the ends thereof and having the same section, said straps serving to hold together two consecutive wooden poles end to end and in alignment by means of 16 mm fixing bolts. One of the ends of each of the metal elements 5 was pierced with braking slots 12 having the outline described with reference to FIG. 2, and said metal elements 5 had two deformation zones 8 likewise as described above. From curve 15, it can be seen that at a traction force of about 20 tonnes associated with deformation of 25 mm there is a small point of inflection 16 corresponding to the end of deformation for the deformation zones 8, above which the curve continues until it reaches a traction force of the order of 30 tons or even greater, with the set of rail elements being subject to an extension equal to 60 mm at a breaking point 18 for the metal strap.

As mentioned above, beyond this point, if use is made of abutment bars extending perpendicularly to the axes of the bolts 9, a small amount of residual strength can still be recovered corresponding to the drooping portion 19 of the curve, as shown, thereby guaranteeing that the crash barrier remains intact without breaking up completely.

Above FIG. 5 shows clearly that test results correspond to superposition and addition of the strength available firstly from the wooden element and secondly from the continuous metal element running along the back thereof, giving a curve of deformation in response to force that is continuous without discontinuity at steps that would run the risk of causing the crash barrier to break under dynamic conditions.

In addition, it will be possible to add a vertical flange to the rear portion of each fixing post 2 as shown in FIG. 3, fixed solely to the rearmost strap 6 between the ends of the strip-forming rear rectangular plates 5, which flange could be held by a bolt for fixing to the strap 6 and by an anchor bolt at its bottom end. Such a vertically extending flange makes it possible to keep the posts, even after they have broken, fixed to the strap so as to prevent them flying loose after being torn away therefrom.

We claim:

1. A road crash barrier comprising at least one horizontal rail having wooden elements that are assembled end to end and that are supported by posts, the rail being covered over a portion of its surface with a continuous metal strip, the strip having elongate plane rectangular plates of small section that are fixed against a surface of the rail facing away from a road traffic axis, the rectangular plates lying in a horizontal plane that includes the axis of the rail, at least one of said rectangular plates having at least one deformation zone capable of enabling each length of the strip corresponding to an associated wooden element to lengthen by a certain amount.

2. A road crash barrier according to claim 1, wherein the deformation zone has a fold in the rectangular plate formed in the horizontal plane including the axis of the rail.

3. A road crash barrier according to claim 1, wherein the rectangular plates have, at each end, holes through which fixing bolts pass for fixing the rectangular plates to a coupling plate and to the associated wooden element, at least one of the holes being elongate in shape.

4. A road crash barrier according to claim 3, wherein the elongate holes are braking slots having an aperture diameter "r" that is smaller towards an end of the rectangular plate in which they are formed.

5. A road crash barrier according to claim 1, wherein each wooden element is associated with a rectangular plate of greater length and projecting beyond at least one end of the wooden element, an end of the rectangular plate being deformed to overlie an end of the rectangular plate of the adjacent wooden element, the ends being fixed to each other and to the wooden element by bolts that pass through the wooden element.

6. A road crash barrier according to claim 1, wherein each wooden element is associated with a rectangular plate having a length no longer than the wooden element, and a first coupling piece disposed behind the rail relative to the road traffic axis, the first coupling piece extends between and overlies the ends of two adjacent wooden elements and the two rectangular plates associated with the wooden elements, thereby coupling them together and fixing them by bolts that pass through and clamp simultaneously the wooden element, the rectangular plate, and the first coupling piece.

7. A road crash barrier according to claim 1, wherein the surface of the rail facing road traffic includes a coupling strap lying in the horizontal plane and extending between two ends of the wooden elements, and being fixed thereto by means of bolts passing through the wooden elements, clamping them between the coupling strap and the rectangular plates to form the continuous strip at the back of the rail.

8. A road crash barrier according to claim 6, further comprising a second coupling piece at the back of the rail, extending between and overlying the ends of two adjacent wooden elements wherein the first and second coupling pieces sandwich the ends of the two associated rectangular plates.

9. A road crash barrier according to claim 3, wherein portions of the rectangular plates and the coupling pieces which come into direct contact against the wooden elements carry spikes that penetrate into the wooden elements.

10. A road crash barrier according to claim 2, further comprising abutment bars placed vertically in a midplane of the wooden elements perpendicularly to the longitudinal axis thereof and to an axis of fixing bolts, at a given distance therefrom towards the ends of the wooden elements.

* * * * *